United States Patent [19]

Yuzawa et al.

[11] 4,381,753

[45] May 3, 1983

[54] EVAPORATIVE EMISSION CONTROL DEVICE OF AN INTERNAL COMBUSTION ENGINE FOR VEHICLE USE

[75] Inventors: Teruo Yuzawa, Oomiya; Masaaki Uchida, Kawagoe, both of Japan

[73] Assignee: Honda Giken Kogyo Kabushiki Kaisha, Tokyo, Japan

[21] Appl. No.: 204,620

[22] Filed: Nov. 6, 1980

[30] Foreign Application Priority Data

Nov. 12, 1979 [JP] Japan ..... 54-156698[U]

[51] Int. Cl.[3] ..... F02M 33/02

[52] U.S. Cl. ..... 123/520; 74/860

[58] Field of Search ..... 123/514, 520, 521, 339, 123/518, 517, 519; 74/860

[56] References Cited

U.S. PATENT DOCUMENTS 4,127,097 11/1978 Takimoto ..... 123/520

4,258,685 3/1981 Arai ..... 123/520

4,275,016 6/1981 Morino ..... 123/519

*Primary Examiner*—Charles J. Myhre

*Assistant Examiner*—Carl Stuart Miller

*Attorney, Agent, or Firm*—Posnack, Roberts, Cohen & Spiecens

[57] ABSTRACT

An improved evaporative emission control device of an internal combustion engine having a variable venturi type carburetor which is effective to reduce unburnt components in the exhaust gas over the entire range of engine operation. Fuel vaporized in a fuel tank, a float chamber or the like and stored in a canister containing activated charcoal is supplied to an intake passage of the carburetor through a supply port which opens into the intake passage at a location between a throttle valve and a venturi valve which is disposed in the intake passage to vary the opening area of the venturi. A valve is disposed in a line connecting the supply port and the canister to control fuel vapor passing through the line. The valve is controlled to open and close in response to the operations of a clutch and/or a transmission device interposed in a power transmission system for conducting power from the engine to driving wheels.

11 Claims, 2 Drawing Figures

EVAPORATIVE EMISSION CONTROL DEVICE OF AN INTERNAL COMBUSTION ENGINE FOR VEHICLE USE

FIELD OF THE INVENTION

The present invention relates to an evaporative emission control device of an internal combustion engine for vehicle use in which a vaporized fuel absorbed by a canister is supplied through a fuel vapor supply passage to an intake passage of a carburettor.

DESCRIPTION OF PRIOR ART

It has been known to supply the vaporized fuel stored in the canister either downstream of a throttle valve disposed within the intake passage of the carburettor or upstream of a variable venturi valve. In the former case, vacuum in the intake passage downstream of the throttle valve is in inverse proportion to the air flow rate in the intake passage so that when vaporized fuel from the canister is supplied to the intake passage during low load operation of the engine, the air-fuel ratio of mixture is disturbed to increase unburnt components such as HC within the exhaust gas which produce an undesirable effect on the engine operation. In the latter case, the above disadvantages encountered in the former case can be avoided but the fuel vapor supply passage must be constructed to have a large internal diameter to compensate for a reduction in vacuum pressure.

Further, when the flow rate of air induced into the intake passage of the carburettor is extremely low, for example, during idling of the engine, supply of the fuel vapors disturbs the air-fuel ratio of the mixture within the intake passage, thereby adversely affecting as well as increasing the unburnt components in the exhaust gas.

SUMMARY OF THE INVENTION

A major object of the present invention is to provide an evaporative emission control system of an internal combustion engine for vehicle use in which fuel purged from a canister can be supplied to the intake passage in proportion to the air flow rate within the intake passage thereby to prevent the disturbance of the air-fuel ratio of the mixture so that the engine operation can be stabilized to reduce unburnt components discharged into the atmosphere as much as possible.

Another object of the present invention is to provide an evaporative emission control system of an internal combustion engine for vehicle use in which when the air flow rate in the intake passage of the carburettor is low, for example, during idling of the engine, supply of purge fuel to the intake passage is cut off to prevent the disturbance of the air-fuel ratio of mixture so as to reduce, as much as possible, the amount of unburnt components contained in the exhaust gas.

The above and other objects, features and advantages of the invention will become apparent from the following description of a preferred embodiment of the invention when taken in conjunction with the accompanying drawing.

DESCRIPTION OF THE PREFERRED EMBODIMENT

One preferred embodiment of the present invention will be described hereinafter with reference to the accompanying drawing.

Figure 1:
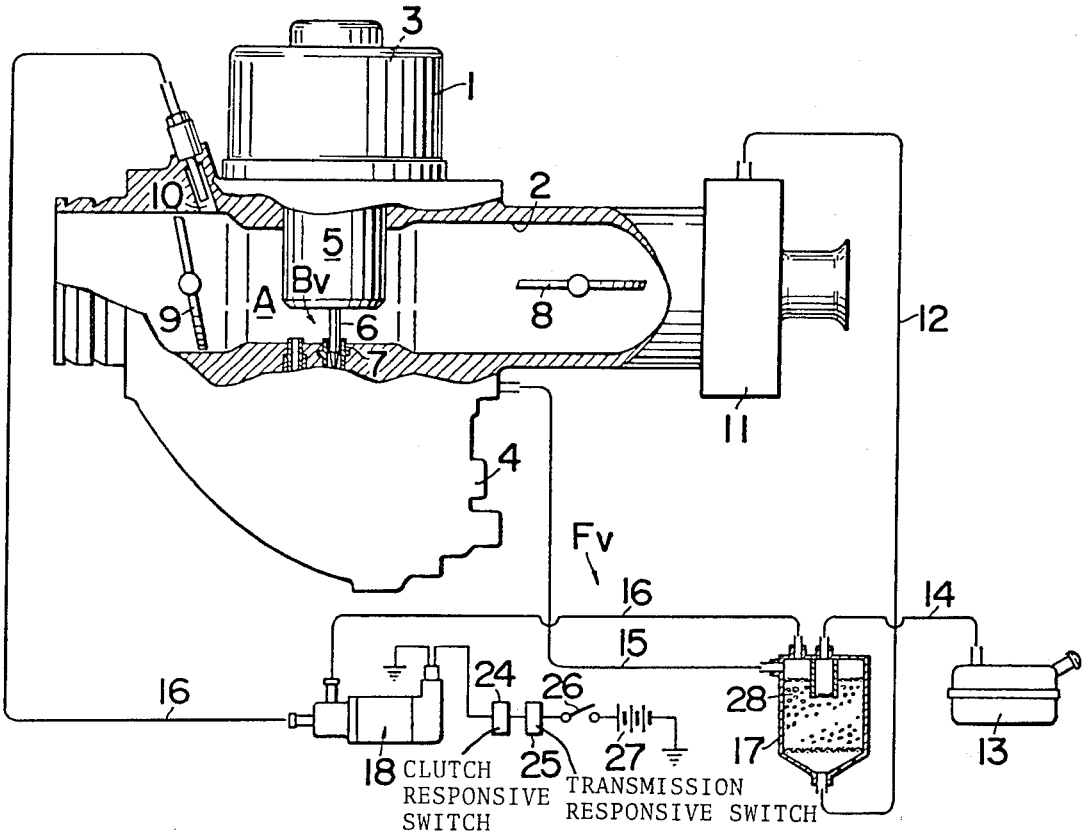
FIG. 1 is a schematic view, partly broken away and in section, showing an evaporative emission control device embodying the present invention.

In FIG. 1 there is shown an evaporative emission control system applied to a variable venturi type carburettor. The carburettor includes a carburettor body 1 which has an intake passage 2 which is in communication at its upstream end with the atmosphere through an air-cleaner 11 and at its downstream end with an intake port of an internal combustion engine for vehicle use (not shown). Above the intake passage 2 is disposed a vacuum chamber 3 for receiving vacuum in the intake passage 2 while below the passage 2 is disposed a float chamber 4. A suction piston 5 projects into the intake passage 2 and moves up and down in response to variations in vacuum pressure within the intake passage 2 to form therein a variable venturi Bv. From a lower end of the suction piston 5 is suspended a jet needle 6 which is inserted into a main nozzle 7, which opens into the variable venturi Bv of the intake passage 2, so as to change the opening area of the main nozzle 7. A choke valve 8 and a throttle valve 9 are disposed in the intake passage 2 upstream and downstream, respectively, of the suction piston 5. The above arrangement is the same as that of variable venturi carburettors of the prior art.

A fuel vapor supply port 10 opens into the intake passage 2 at a location between the suction piston 5 and the throttle valve 9. The supply port 10 is subjected to substantially the same vacuum pressure as that at the variable venturi Bv and is fed with fuel vapor from a fuel vapor supplying device Fv which will be described in detail hereinafter.

Figure 2:
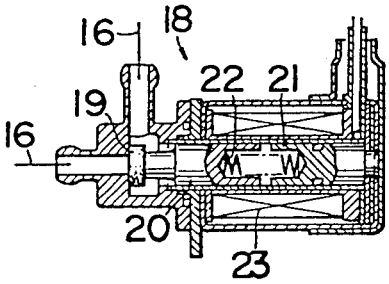
FIG. 2 is a longitudinal sectional view of an electromagnetic valve shown in FIG. 1.

The structure of the fuel vapor supplying device Fv, as shown in FIG. 1, comprises a fuel vapor storage canister 17 containing activated charcoal 28 or other fuel vapor adsorbent in communication at one end with ambient air through a passage 12 and the air-cleaner 11 and at the other end with upper portions of a fuel tank 13, the float chamber 4 through induction passages 14, 15 and further with the fuel vapor supply port 10 through a fuel vapor purge line 16. In the purge line 16 is interposed a normally closed electromagnetic valve 18 for opening and closing the line 16. As shown in detail in FIG. 2, the electromagnetic valve 18 includes a movable element 20 integrally formed with a valve body 19 which is present in the interior of the purge line 16, a fixed element 21 disposed in a valve box, a compression spring 22 interposed between the movable and fixed elements 20, 21 for biasing the valve element 19 in the closing direction, and a solenoid 23 surrounding the movable and fixed elements 20, 21. The solenoid 23 is connected to a battery 27 via a first switch 24, a second switch 25 and a main switch 26. The first switch 24 is opened and closed in response to the engagement and disengagement of a clutch means (not shown) which controls power transmission of a power transmission system interconnecting the engine and driving wheels of the vehicle. The second switch 25 is opened and closed in response to the speed changing operation of a transmission device of the power transmission system. With this arrangement, when the clutch means is placed into an engaging position and the transmission device is shifted into a gearing or power transmitting position (except for its neutral position) after closure of the main switch 26, i.e. after start of the engine, the first and second switches 24 and 25 are both closed to energize the solenoid 23 thereby to open the electromagnetic valve 18 so that fuel vapor purged from the canister 17 can be supplied to the fuel vapor supply port 10.

In operation, when the engine is started, fuel stored in the float chamber 4 is sucked into the intake passage 2 through the main nozzle 7 under the action of intake air flowing through the variable venturi Bv to produce an air-fuel mixture which is fed to a combustion chamber of the engine. In this carburettor of variable venturi type, during low load operation of the engine wherein the opening of the throttle valve 9 is small, that is, when the amount of air flowing in the intake passage is small, the air flow rate in the venturi Bv is small and accordingly vacuum pressure developed therein is low so that the suction piston 5 is kept in a lower position to adjust the amount of purge fuel sucked from the supply port 10 into the intake passage 2 to a reduced value. On the other hand, during heavy load operation of the engine wherein the opening of the throttle valve 9 is large, that is, when the flow of intake air is large, an increased or high vacuum pressure develops in the variable venturi Bv and is transmitted to the vacuum chamber 3 so that the suction piston 5 is raised to adjust the amount of purge fuel to an increased value.

In the meantime, since a space A in the intake passage 2 between the suction piston 5 and the throttle valve 9 is in direct communication with the variable venturi Bv, vacuum pressure in the space A is held approximately equal to the vacuum pressure at the venturi Bv and hence is almost proportional to the flow rate of intake air.

In this state, if the clutch means is engaged to turn on the first switch 24 and at the same time the transmission device is shifted to a gearing or power transmitting position to turn on the second switch 25, the solenoid 23 is energized to open the electromagnetic valve 18 so that fuel vapor from the canister 17 can be discharged into the space A through the purge line 16 and the fuel vapor supply port 10. In this connection, it is to be noted that vacuum pressure in the space A increases in proportion to an increase in flow rate of the intake air. Therefore, when the amount of intake air is large, the amount of purge fuel fed from the supply port 10 to the intake passage 2 also becomes large whereas when the amount of intake air is small, the amount of purge fuel also becomes small whereby no significant disorder of the air-fuel ratio of the mixture to be delivered to the engine takes place.

Further, when power transmission of the power transmission system is halted, in other words, when the clutch means is out of engagement or when the transmission device is not in a gearing or power transmitting position, i.e. the transmission device is in its neutral position, the first or second switch 24, 25 is in the off state to close the electromagnetic valve 18 thereby to cut off the supply of fuel vapor to the intake passage 2. Therefore, when the amount of air flowing in the intake passage 2 is small, for example, at the time of engine idling, fuel vapor fed from the supply port 10 to the intake passage 2 can be securely halted so as to prevent disturbance of the air-fuel ratio of the mixture. In consequence, unburnt components in the exhaust gas can be greatly reduced.

In actual circumstances, an automobile is sometimes halted at a road crossing with the transmission shifted to a low-speed position and the clutch means disengaged. In such case, for stabilizing the idling operation of the engine, it is desirable to close the second switch 25 when the transmission device is shifted to a second-speed position.

As described above, according to one aspect of the present invention, the fuel vapor supply port 10 is arranged at open to the intake passage 2 of the variable venturi type carburettor at a location between the venturi valve 5 and the throttle valve 9 so that fuel vaporized in a fuel vapor, such as the fuel tank 13 and/or the float chamber 4 and stored in the canister 17, is fed to the intake passage 2 through the supply port 10 in an amount substantially proportional to the rate of air flow in the intake passage 2. Accordingly, disturbance of the air-fuel ratio of the mixture is prevented in all engine operations thereby to stabilize the running of the engine and at the same time to greatly reduce unburnt components discharged to atmosphere. In addition, a high vacuum pressure as required to suck fuel vapor into the intake passage 2 can be obtained at the supply port 10 so that a desired large quantity of vaporized fuel can be supplied to the intake passage 2 without enlarging the internal diameter of the vapor supply passage such as the line 16, passages 14, 15 or the like.

Further, according to another aspect of the present invention, in the fuel vapor purge line 16 connecting the intake passage 2 and the canister 17 there is interposed valve 18 which is adapted to open when the transmission device of the power transmission system interconnecting the internal combustion engine and the driving wheels of the vehicle is in any power transmitting position other than its neutral postion, whereby when the amount of air sucked in the intake passage 2 is extremely low as during idling of the engine, supply of fuel vapor to the intake passage 2 can be reliably cut off to prevent disorder of the air-fuel ratio of the mixture. As a result, unburnt components in the exhaust gas can be reduced to a considerable extent and the engine operation can be improved in all operational ranges thereof.

What is claimed is:

1. In an evaporative emission control device of an internal combustion engine for vehicle use having a variable venturi type carburettor which includes an intake passage formed in a carburettor body, a venturi valve in said intake passage for variably adjusting an opening area of a venturi formed in said intake passage, and a throttle valve in said intake passage downstream of said venturi valve to control the amount of air-fuel mixture flowing in said intake passage, the improvement comprising a fuel vapor supply port opening in said intake passage at a location between said venturi valve and said throttle valve for supplying fuel vapor to said intake passage, said port being upstream of said throttle valve for all positions of the throttle valve, a fuel vapor storage canister for storing fuel vapor from a fuel vapor source, a fuel vapor purge line interconnecting said canister and said supply port for supplying fuel vapor purged from said canister to said supply port and valve means disposed in said purge line for controlling the flow of fuel vapor purged from said canister, said valve means being adapted to open when a transmission device interposed in a power transmission system which interconnects said internal combustion engine and driving wheels of the vehicle is in a power transmitting position.

2. An evaporative emission control device as claimed in claim 1, wherein said valve means is adapted to open both when the transmission device interposed in the power transmission system is in the power transmitting position and when clutch means for controlling power transmission of said power transmission system is engaged.

3. An evaporative emission control device as claimed in claim 2, wherein said valve means comprises an electromagnetic valve connected to an electric source through a main switch, a first switch and a second switch in series connection with each other, said first switch being adapted to open and close in response to the engagement and disengagement of said clutch means, said second switch being adapted to open and close in response to the speed changing operation of said transmission device.

4. An evaporative emission control device as claimed in claim 3, wherein said fuel vapor source comprises a fuel tank.

5. An evaporative emission control device as claimed in claim 3, wherein said fuel vapor source comprises a float chamber of said carburettor.

6. An evaporative emission control device as claimed in claim 1 or 2, wherein said fuel vapor source comprises a fuel tank.

7. An evaporative emission control device as claimed in claim 1 or 2, wherein said fuel vapor source comprises a float chamber of said carburettor.

8. An evaporative emission control device as claimed in claim 1 wherein said intake passage defines a space between the throttle valve and the venturi valve, said fuel vapor supply port opening into said space such that the amount of purge fuel fed to the intake passage is proportional to the flow rate of the intake air in said passage.

9. In an evaporative emission control device of an internal combustion engine for vehicle use having a variable venturi type carburettor which includes an intake passage formed in a carburettor body, a venturi valve in said intake passage for variably adjusting an opening area of a venturi formed in said intake passage, downstream of said venturi valve to control the amount of air-fuel mixture flowing in said intake passage, the method comprising storing fuel vapor from a fuel vapor source in a canister, supplying the fuel vapor to said intake passage into a space between the venturi valve and the throttle valve for all positions of the throttle valve so that purge fuel fed to the intake passage is proportional to the flow rate of intake air in said intake passage as controlled by said throttle valve, controlling the supply of fuel vapor to said intake passage externally of said passage by opening the supply of fuel vapor to the intake passage when a transmission device interposed in a power transmission system which interconnects said internal combustion engine and driving wheels of the vehicle is in a power transmitting position and closing the supply of fuel vapor to the intake passage when said transmission device is in neutral.

10. A method as claimed in claim 9 wherein the opening of the supply of fuel vapor to the intake passage is effected both when the transmission device interposed in the power transmission system which interconnects said internal combustion engine and driving wheels of the vehicle is in the power transmitting position and when clutch means for controlling power transmission of said power transmission system is energized and the closing of the supply of fuel vapor to the intake passage is effected when said transmission device is in neutral or when said clutch means is disengaged.

11. A method as claimed in claim 9 wherein said fuel vapor is fed into the intake passage at a port subjected to substantially the same vacuum pressure prevailing at the venturi.

* * * * *